US009032561B2

(12) United States Patent
Chen et al.

(10) Patent No.: US 9,032,561 B2
(45) Date of Patent: May 19, 2015

(54) LEVER CONTROL MECHANISM OF A DRAIN VALVE OF A TOILET TANK

(75) Inventors: Meijuan Chen, Xiamen (CN); Xingdong Wang, Xiamen (CN); Bing Wang, Xiamen (CN)

(73) Assignee: R&T (Xiamen) PLUMBING TECHNOLOGY INC., Xiamen (CN)

( * ) Notice: Subject to any disclaimer, the term of this patent is extended or adjusted under 35 U.S.C. 154(b) by 535 days.

(21) Appl. No.: 13/487,941

(22) Filed: Jun. 4, 2012

(65) Prior Publication Data

US 2013/0199315 A1 Aug. 8, 2013

(30) Foreign Application Priority Data

Feb. 6, 2012 (CN) ..... 2012 2 0035491

(51) Int. Cl.
*E03D 1/00* (2006.01)
*E03D 5/092* (2006.01)

(52) U.S. Cl.
CPC ..... *E03D 5/092* (2013.01); *Y10T 74/18216* (2015.01)

(58) Field of Classification Search
USPC ..... 4/405, 413, 414
See application file for complete search history.

(56) References Cited

U.S. PATENT DOCUMENTS

| | | | | |
|---|---|---|---|---|
| 945,424 | A * | 1/1910 | Tilden | 4/414 |
| 3,419,912 | A * | 1/1969 | Kertell | 4/324 |
| 4,575,881 | A * | 3/1986 | Rozek | 4/405 |
| 6,637,044 | B2 | 10/2003 | Rische et al. | |

* cited by examiner

*Primary Examiner* — Huyen Le
(74) *Attorney, Agent, or Firm* — Rabin & Berdo, P.C.

(57) ABSTRACT

A lever control mechanism of a drain valve of a toilet tank has a lever assembly assembled in the wall of the toilet tank and a lever linked to the revolving shaft of the lever assembly. The lever assembly is connected to a deviator, which is disposed with a drive arm; the drive arm is connected to the revolving shaft. The deviator is disposed with a joint portion and at least a leading hole to limit the lever revolving vertically. One end of the lever is run through the leading hole to rotationally connect to the joint portion; the drive arm is revolved by the driving of the revolving shaft to drive the lever revolved in the fan shaped vertical surface limited formed by the joint portion and the leading hole.

8 Claims, 3 Drawing Sheets

LEVER CONTROL MECHANISM OF A DRAIN VALVE OF A TOILET TANK

FIELD OF THE PATENT FOR INVENTION

The patent for invention relates to a control mechanism for the flapper drain valve of the toilet tank, especially to a lever control mechanism of a drain valve of a toilet tank.

BACKGROUND OF THE PATENT FOR INVENTION

The top of the right side wall or the left side wall of the existing toilet tank is assembled with a control mechanism for the flapper drain valve of the bar shaped tank, which comprising a screw, a bolt, a lever and a lever handle with a revolving shaft, the revolving shaft is sleeved to the bolt, the end of the revolving shaft is connected to a lever of curved, the bolt is fixedly connected to the wall of the tank by nut. By driving the lever handle revolved, the revolving shaft drives the copper lever revolved. The flapper of the existing drain valve is connected to the end of the copper lever by chain, the end of the copper lever is moved up or down with revolving. The flapper is open or closed by pulling the chain or releasing the chain. As the copper lever is curved in a certain angle to realize the motion of the lever body in revolving, the motion trace of the copper lever is not a vertical surface but a curved surface in vertical direction when the copper lever is raised. A larger distance between the copper lever and the front wall of the tank is needed for the revolving room, so a larger width of the tank is needed. The lever control mechanism is inapplicable in the tank with small width.

SUMMARY OF THE PATENT FOR INVENTION

To solve the above problems, the patent for invention is provided with a lever control mechanism of a drain valve of a toilet tank, which makes the motion trace of the lever from curved surface to vertical surface by a deviator. The distance between the lever and the wall of the tank is decreased, making the tank of narrow in width applicable.

The patent for invention is provided with a lever control mechanism of a drain valve of a toilet tank, which comprising a lever assembly assembled in the wall of the toilet tank, the lever control device comprising a revolving shaft; a lever linked to the revolving shaft of the lever assembly, wherein: The lever assembly is connected to a deviator, which is disposed with a drive arm, the drive arm is connected to the revolving shaft; the deviator is disposed with a joint portion and at least a leading hole to limit the revolving of the lever in vertical direction, one end of the lever is run through the leading hole to rotationally connect to the joint portion; the drive arm is revolved by the driving of the revolving shaft to drive the lever revolved in the fan shaped vertical surface limited formed by the joint portion and the leading hole.

The lever assembly further comprising a lever handle, one end of which is connected to the revolving shaft; a bolt cooperated with the revolving shaft to be inserted and revolved, a clamping nut screwed connected to the bolt and a lock nut screwed connected to the bolt to fix the deviator to the bolt. The revolving shaft is inserted into the bolt to make the lever handle positioned in one end of the revolving shaft, the revolving shaft is extended to the other end. Sleeve the bolt to the assembly hole of the tank wall, then fix the deviator and the bolt by the lock nut, and fix the bolt to the tank wall by revolving the lock nut, making the lever assembly and the deviator fixed to the tank wall.

The deviator connected to the lever assembly further comprising an mounting box and a cover, the mounting box is disposed with a connection pipe sleeved with the bolt, the lock nut is connected to the bolt and the connection pipe, the revolving shaft is inserted into the mounting box to connected to the connecting end of the drive arm.

The joint portion is disposed in the mounting box, the leading hole has two, the corresponding joint portions of the two leading hole are separately disposed in the mounting box and the cover, one end of the lever is inserted to the two leading holes to hinge joint to the hinge joint portion, the revolving end of the drive arm of the mounting box is cooperated with the lever. The lever is raised by the revolving of the drive arm driven by the revolving shaft, making the hinge joint end of the lever revolved and the lever raised in vertical direction with the leading of the leading hole. The motion trace of the lever is fan shaped vertical surface. The connecting end of the drive arm is disposed with hinge joint hole, which is inserted fixed with the revolving shaft. Drive the lever handle to make the revolving shaft revolved, the revolving shaft drives the drive arm revolved, the drive arm drives the lever moving up or down.

The revolving end of the drive arm is disposed with a abdication hole to drive the lever; the lever is inserted into the abdication hole. Drive the to drive arm revolved to make the abdication hole driving the lever moving up or down.

One end of the lever is pivotally connected to the joint portion by a pin, making one end of the lever and the joint portion pivotally connected together, making the lever revolved about the joint portion.

The mounting box is screwed to the cover. The mounting box and the cover sleeved together are screwed together.

The advantages of the patent for invention is as below: the revolving of the revolving shaft of the lever assembly drives the drive arm revolved, making the end of the drive arm driving the lever moving upwards. As one end of the lever is rotationally connected to the deviator, the other end of the lever is moved upward about the joint portion with the leading of the leading hole of the deviator, the motion trace of the lever is fan shaped vertical surface, making the distance between the lever and the tank wall decreased. The patent for invention is applicable in the tank with narrow width.

In the figures, 10. lever assembly, 11. lever handle, 111. revolving shaft, 12. bolt, 13. clamping nut, 14. lock nut, 20. deviator, 21. mounting box, 211. connection pipe, 212. joint portion, 213. the leading hole of the mounting box, 22. cover, 221. leading hole of the cover, 30. lever, 31. the joint end of the lever, 32. the function end of the lever, 40. drive arm, 41. hinge joint hole, 42. abdication hole, 50. pin, 60. screw.

DETAILED DESCRIPTION OF EMBODIMENT

The patent for invention is further described with combination with the drawings and the embodiment.

Figure 1:
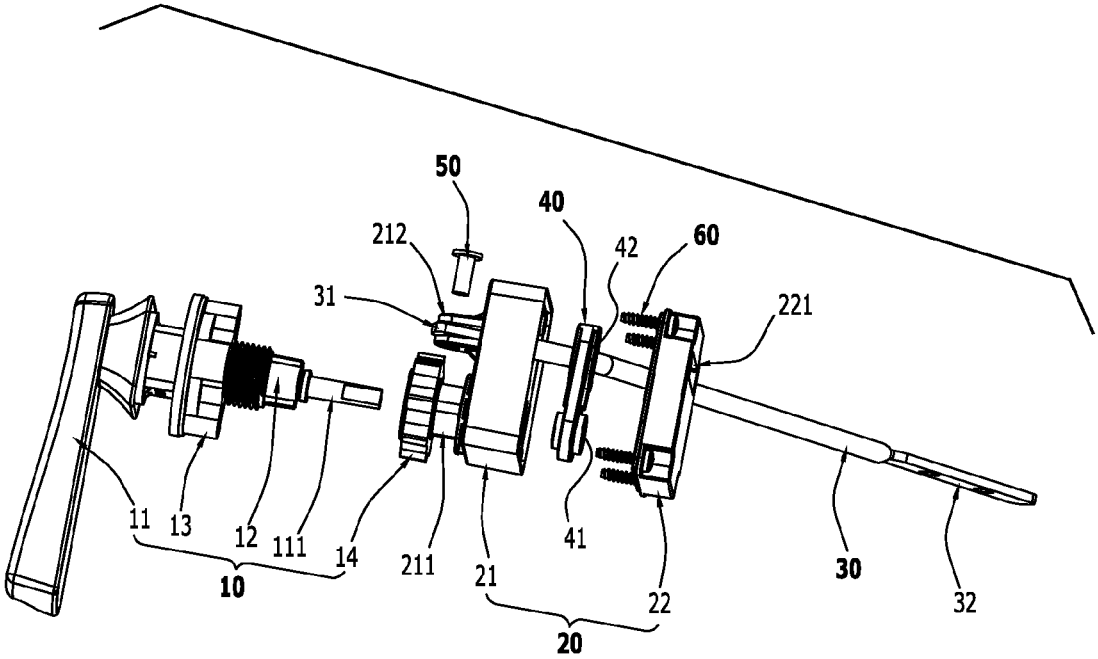
FIG. 1 illustrates the breakdown structure of the patent for invention.
Figure 2:
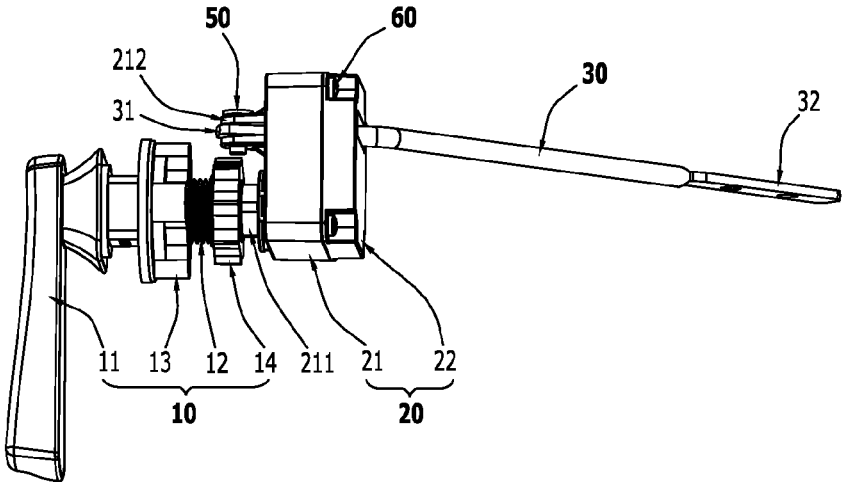
FIG. 2 illustrates the structure of the patent for invention.
Figure 3:
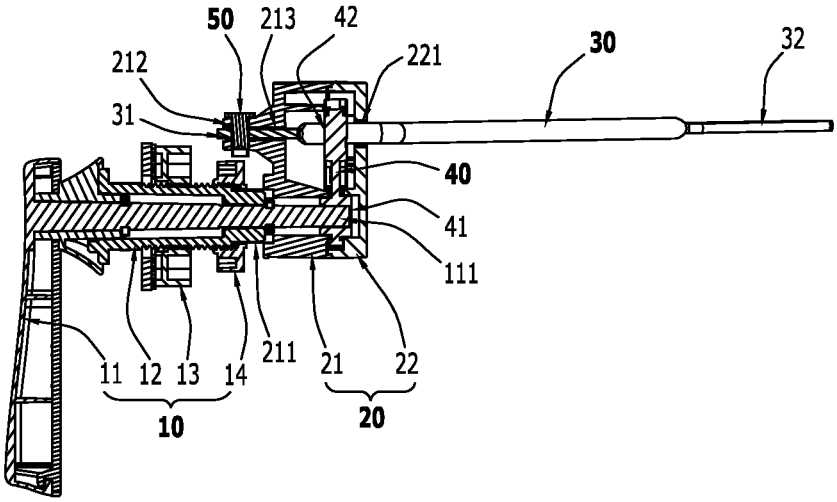
FIG. 3 illustrates the sectional view of the patent for invention.
Figure 4:
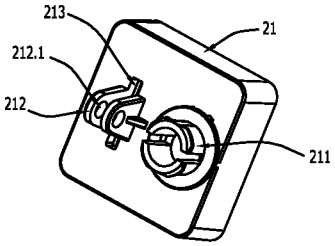
FIG. 4 illustrates the structure of the mounting box of the deviator of the patent for invention.
Figure 5:
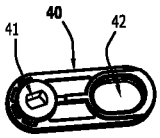
FIG. 5 illustrates the structure of the revolving mechanism of the patent for invention.

As figured in the FIG. 1 to the FIG. 3, a lever control mechanism of a drain valve of a toilet tank comprising a lever assembly 10 assembled in the wall of the tank of the toilet and a lever 30 linked to the revolving shaft 111 of the lever assembly 10. the lever assembly 10 comprising a lever handle 11, one end of which is connected to the revolving shaft 111, a bolt 12 for the revolving shaft 111 to be inserted into and revolved, a clamping nut 13 screwed connected to the bolt 12 and a lock nut 14 screwed connected to the bolt 12 to fix the deviator 20 to the bolt 12. The lever assembly 10 is connected to the deviator 20, which is disposed with a drive arm 40. The deviator 20 comprising an mounting box 21 and a cover 22 connected together by a screw 60, as figured in the FIG. 3 to the FIG. 5, the mounting box 21 is disposed with a connection pipe 211 sleeved with the bolt 12, the lock nut 14 is connected to the bolt 12 and the connection pipe 211, the revolving shaft 111 is inserted into the mounting box 21 to be fixed with the hinge joint hole 41 of the connecting end of the drive arm 40. The mounting box 21 is disposed with a joint portion 212; there are two leading holes to limit the revolving of the lever 30 in vertical direction. The leading hole 213 of the mounting box and the leading hole 221 of the cover is correspondence to the joint portion 212; the abdication hole 42 of the revolving end of the drive arm 40 is correspondence to the joint portion 212. the joint end 31 of the lever is run through the leading hole 221 of the cover, the abdication hole 42, the leading hole 213 of the mounting box and then rotationally connected to the joint portion 212 by pin 50. The abdication 42 of the revolving end of the drive arm 40 of the mounting box 21 is cooperated with the lever 30. the function end of the lever 31 is extended out of the deviator 20. That's the assembly of the patent for invention.

Assemble the patent invention to the side wall of the toilet tank; the operation principle and the detailed description of the embodiment are further described as below.

Figure 6:
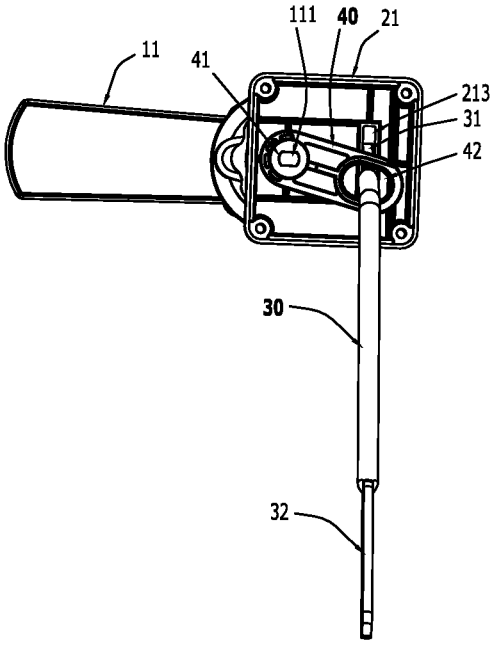
FIG. 6 illustrates the structure of the patent for invention in the initial status.
Figure 7:
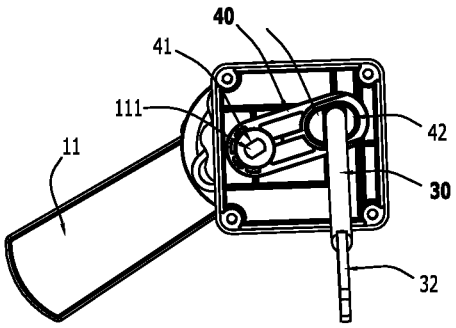
FIG. 7 illustrates the structure of the patent for invention in working status.

As figured in the FIG. 3, FIG. 6 and FIG. 7, drive the lever handle 11 of the lever assembly 10, the lever handle 11 drives the revolving shaft 111 and the drive arm 40 of the deviator 20 revolved, the abdication hole 42 of the drive arm 40 moves upwards to drive the lever 30, making the hinge joint end 31 of the lever 30 revolved about the pin 50 of the joint portion 212 to move upwards, the function end 32 of the lever 30 moves upwards, with the limit and the leading of the leading hole 213 of the mounting box and the leading hole 221 of the cover, the motion trace of the lever 30 is fan shaped vertical surface, making the distance between the lever and the tank wall decreased. The patent for invention is applicable in the tank with narrow width.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The patent for invention is provided with a lever control mechanism of a drain valve of a toilet tank, which comprising a lever assembly assembled in the wall of the toilet tank and a lever linked to the revolving shaft of the lever assembly. The lever assembly is connected to a deviator, which is disposed with a drive arm; the drive arm is connected to the revolving shaft; The deviator is disposed with a joint portion and at least a leading hole to limit the revolving of the lever in vertical direction, one end of the lever is run through the leading hole to rotationally connect to the joint portion; the drive arm is revolved by the driving of the revolving shaft to drive the lever revolved in the fan shaped vertical surface limited formed by the joint portion and the leading hole. The motion trace of the lever is fan shaped vertical surface, making the distance between the lever and the tank wall decreased. The patent for invention is applicable in the tank with narrow width with well industrial applicability.

What is claimed is:

1. A lever control mechanism of a drain valve of a toilet tank comprising:

A lever assembly assembled in a wall of the toilet tank, the lever assembly comprising a revolving shaft;

A lever linked to the revolving shaft of the lever assembly, wherein:

The lever assembly is connected to a deviator, which is disposed with a drive arm; the drive arm is connected to the revolving shaft;

The deviator is disposed with a joint portion and at least a leading hole to limit the revolving of the lever in vertical direction, one end of the lever is run through the leading hole to rotationally connect to the joint portion; the drive arm is revolved by the driving of the revolving shaft to drive the lever revolved in a fan shaped vertical surface limited formed by the joint portion and the leading hole.

2. a lever control mechanism of a drain valve of a toilet tank according to the claim 1, wherein the lever assembly further comprising a lever handle, one end of which is connected to the revolving shaft, a bolt cooperated with the revolving shaft to be inserted and revolved, a clamping nut screwed connected to the bolt and a lock nut screwed connected to the bolt to fix the deviator to the bolt.

3. a lever control mechanism of a drain valve of a toilet tank according to the claim 1, wherein the deviator connected to the lever assembly further comprising an mounting box and a cover, the mounting box is disposed with a connection pipe sleeved with the bolt, the lock nut is connected to the bolt and the connection pipe, the revolving shaft is inserted into the mounting box to connected to the connecting end of the drive arm.

4. a lever control mechanism of a drain valve of a toilet tank according to the claim 3, wherein the connecting end of the drive arm is disposed with hinge joint hole, which is inserted fixed with the revolving shaft.

5. a lever control mechanism of a drain valve of a toilet tank according to the claim 3, wherein one end of the lever is pivotally connected to the joint portion by a pin.

6. a lever control mechanism of a drain valve of a toilet tank according to the claim 3, wherein the mounting box is screwed to the cover.

7. a lever control mechanism of a drain valve of a toilet tank according to the claim 1, wherein the joint portion is disposed in the mounting box with two leading hole, the corresponding joint portions of the two leading holes are separately disposed in the mounting box and the cover, one end of the lever is inserted to the two leading holes to be hinged to the joint portion, the revolving end of the drive arm of the mounting box is cooperated with the lever.

8. a lever control mechanism of a drain valve of a toilet tank according to the claim 7, wherein the revolving end of the drive arm is disposed with a abdication hole to drive the lever, the lever is inserted into the abdication hole.

* * * * *